US006587100B1

(12) United States Patent
Shirasaki

(10) Patent No.: US 6,587,100 B1
(45) Date of Patent: Jul. 1, 2003

(54) DISPLAY DEVICE DRIVER CIRCUIT

(75) Inventor: Hijiri Shirasaki, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/534,504

(22) Filed: Mar. 24, 2000

(30) Foreign Application Priority Data

Sep. 7, 1999 (JP) ..... 11-252733

(51) Int. Cl.[7] ..... G09G 3/36; G09G 5/00

(52) U.S. Cl. ..... 345/204; 345/95; 345/96; 345/97; 345/98; 345/99; 345/100

(58) Field of Search ..... 345/79, 89, 95, 345/98, 100, 204–215; 323/303; 331/116 FE

(56) References Cited

U.S. PATENT DOCUMENTS 4,094,137 A * 6/1978 Morokawa ..... 331/116 FE
4,593,279 A * 6/1986 Leach et al. ..... 340/811
5,122,792 A * 6/1992 Srewart ..... 340/793
5,198,747 A * 3/1993 Haight ..... 323/303
5,283,565 A * 2/1994 Suzuki et al. ..... 345/98
5,574,475 A * 11/1996 Callahan, Jr. et al. ..... 345/100
5,578,957 A * 11/1996 Erhart et al. ..... 327/333
5,633,653 A * 5/1997 Atherton ..... 345/98
5,986,649 A * 11/1999 Yamazaki ..... 345/211
6,225,992 B1 * 5/2001 Hsu et al. ..... 345/211
6,317,122 B1 * 11/2001 Yamazaki ..... 345/211
6,339,413 B1 * 1/2002 Drake et al. ..... 345/213

* cited by examiner

*Primary Examiner*—Bipin Shalwala
*Assistant Examiner*—Prabodh M Dharia
(74) *Attorney, Agent, or Firm*—Volentine Francos, PLLC

(57) ABSTRACT

A display device driver circuit including a first switching circuit for switching connection and disconnection between an output terminal and a first source line; a second switching circuit for switching connection and disconnection between the output terminal and a second source line; and a selecting circuit for switching a voltage output from the output terminal by controlling the first and second switching circuits. The selecting circuit controls the first and second switching circuits so that the timing for opening one of the switching circuits is faster than the timing for closing the other of the switching circuits. Consequently, a time when both switches are open occurs regularly when the voltage output is switched, so that no current will pass between the switching circuits.

31 Claims, 10 Drawing Sheets

Voltages
VU0
VDD
0
N1
Sin
E
F
N2
Time

Voltages
VU0
0
Time
S62
S61
S64
S63
T

Voltages
VU0
0
Time
S63
S61
62
S64
T

DISPLAY DEVICE DRIVER CIRCUIT

BACKGROUND OF THE INVENTION

1. Field of the Invention

The present invention relates to a display device driver circuit. A driver circuit is a circuit for converting driving voltages. The driver circuit relating to the present invention is used to drive liquid crystal displays (LCDs), for example.

2. Description of Related Art

A control circuit is used to drive display devices such as LCDs. Such a control circuit is generally constituted of logic integrated circuits. The LCD control circuit applies the driving voltage in the segment direction and driving voltage in the common direction, that is perpendicular to the segment direction, to the liquid crystal elements. Switching the orientations of the driving voltages applied to the liquid crystal elements switches the transparency and opacity to light incident to the liquid crystal element.

The optimum value of the driving voltage VUO applied to the liquid crystal elements varies depending on the type of liquid crystal. In a usual LCD, the optimum value of the driving voltage VUO will be about six volts at the least and about 50 volts at the most. On the other hand, the driving voltage VDD for a usual logic integrated circuit is three to five volts. The output signal voltage of a logic integrated circuit matches the voltage VDD and is therefore three to five volts. Consequently, the output signal voltage of the logic integrated circuit is preferably not applied without further processing to the LCD as the driving voltage VUO.

A usual LCD control circuit generates the voltage to drive the LCD by converting the output signal voltage of a logic circuit from VDD to VUO. The circuit performing this conversion is called a driver circuit. The driver circuit is established at the final stage of the LCD control circuit.

In order for the conversion of the output signal voltage from VDD to VUO, the voltage VUO must be supplied to the driver circuit. The voltage VUO may also be generated by a power source independent from the power source of the voltage VDD, but in many cases is generated by raising the voltage VDD with a voltage booster circuit.

The driving voltage output terminals of the driver circuit are connected to two switching circuits. One switching circuit connects and disconnects the output terminal and the driving voltage VUO. The other switching circuit connects and disconnects the output terminal and ground. When the switch on the voltage VUO side is closed and the switch on the ground side is open, the output terminal outputs the voltage VUO. Oppositely, when the switch on the voltage VUO side is open and the switch on the ground side is closed, the output terminal outputs zero volts. The opening and closing of these switching circuits is controlled by the output signals of the logic circuit in the previous stage.

When the output voltage of the driver circuit is being switched, the timing for closing one switching circuit is faster than the timing for opening the other switching circuit; as a result, a time when both switching circuits are closed will occur. In this case, pass-through current will flow from the voltage VUO side to the ground side. This pass-through current causes the level of the voltage VUO to drop. This level drop causes deterioration of the LCD image quality. When the voltage VUO is generated by the voltage booster circuit discussed above, the level drop of the voltage VUO becomes particularly great. This is because the voltage VUO generated by the voltage booster circuit is greatly dependent on changes to the size of the load.

SUMMARY OF THE INVENTION

It is an object of the present invention to provide a driver circuit wherein pass-through current is not generated during the switching of the output voltage.

For this reason, the display device driver circuit relating to the present invention comprises first switching means for switching connection and disconnection between the output terminal and the first source line; second switching means for switching connection and disconnection between the output terminal and the second source line; and selecting means for switching the voltage output from the output terminal by switching the first and second switching means open and closed, so that the timing for opening one switching means is faster than the timing for closing the other switching means.

The selecting means control the first and second switching means so that the timing for opening one switching means is faster than the timing for closing the other switching means. Consequently, a time when both switching means are closed will occur regularly when the output voltage is switched; therefore, no current will pass through these switching means.

BRIEF DESCRIPTION OF THE DRAWINGS

Other objects and advantages of the present invention are explained with references to the following attached drawings.

DESCRIPTION OF THE PREFERRED EMBODIMENTS

The preferred embodiments of the present invention are explained below using the drawings. In the figures, the sizes, forms, and disposition of the elements are merely for illustration so that the present invention can be understood; moreover the numerical conditions explained below are simply for illustration.

First Embodiment

Figure 1:
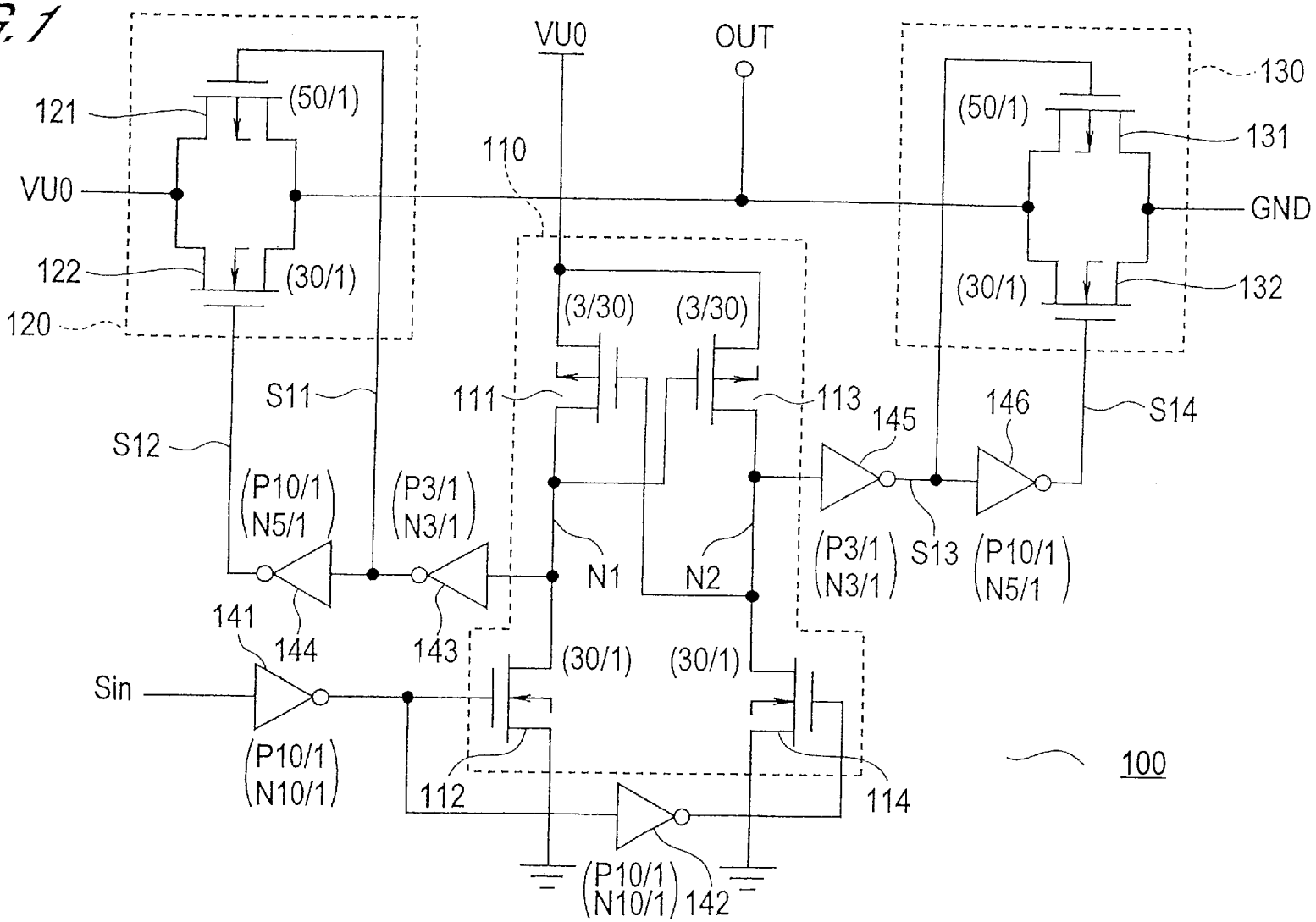
FIG. 1 is a circuit diagram showing the constitution of the display device driver circuit relating to the first embodiment.

FIG. 1 is a diagram of the constitution of the driver circuit relating to the first embodiment of the present invention.

As shown in FIG. 1, the driver circuit 100 relating to the present embodiment comprises a level shifter 110, switching circuits 120 and 130, and inverters 141–146. The level shifter 100 and inverters 141–146 constitute the selecting circuit for controlling switching circuits 120 and 130.

In FIG. 1, the numbers in parentheses associated with the transistors show the gate width and gate length of each transistor. The numbers in parentheses associated with the inverters show the gate width and gate length of the pMOS transistors and nMOS transistors within the inverters.

The driver circuit 100 receives a signal Sin from the logic circuit in the previous stage, not shown, and converts the potential of this signal Sin from VDD to VUO. The converted potential is output from the output terminal OUT.

The level shifter 110 converts the high level potential of the signal Sin from VDD to VUO. The converted potential is supplied to the switching circuits 120 and 130. The level shifter 110 comprises pMOS transistors 111 and 113, and nMOS transistors 112 and 114. Transistors with narrow gate widths and long gate lengths are used as the pMOS transistors 111 and 113. Specifically, as discussed below, pass-through current flows between transistors 111 and 112 and between transistors 113 and 114 in the level shifter 110; this increases the impedance of the pMOS transistors 111 and 113 and makes it difficult for current to flow.

In the pMOS transistor 111, the gate is connected to node N2, the source is connected to the source line of the voltage VUO, and the drain is connected to node N1. In the pMOS transistor 111, the gate width is 3 $\mu$m and the gate length is 30 $\mu$m.

In the nMOS transistor 112, the gate receives the signal Sin via the inverter 141, the source is connected to the ground line, and the drain is connected to the node N1. In the nMOS transistor 112, the gate width is 30 $\mu$m and the gate length is 1 $\mu$m.

In the pMOS transistor 113, the gate is connected to the node N1, the source is connected to the source line of the voltage VUO, and the drain is connected to the node N2. In the pMOS transistor 113, the gate width is 3 $\mu$m and the gate length is 30 $\mu$m.

In the nMOS transistor 114, the gate receives the signal Sin via the inverters 141 and 142, the source is connected to the ground line, and the drain is connected to the node N2. In the nMOS transistor 114, the gate width is 30 $\mu$m and the gate length is 1 $\mu$m.

The switching circuit 120 is a transfer gate for supplying the voltage VUO, meaning a high level potential, to the output terminal OUT. The switching circuit 120 comprises pMOS transistor 121 and nMOS transistor 122. A transistor with a broad gate width and short gate length is used as the pMOS transistor 121. This is because it is preferable that the impedance of the switching circuit 120 be low in order to supply a large current to the display device and cause high speed operation thereof.

The voltage VUO is used as the control voltage of the transistors 121 and 122. The transistors 121 and 122 in the switching circuit 120 have large-sized gates; it is therefore difficult to use VDD as the control voltage. The signal Sin is therefore converted to the voltage VUO by the level shifter 110 and the converted signal is used to control the switching circuit 120.

In the pMOS transistor 121, the gate is connected to node N1 via the inverter 143, the source is connected to the source line of the voltage VUO, and the drain is connected to the output terminal OUT. In the pMOS transistor 121, the gate width is 50 $\mu$m and the gate length is 1 $\mu$m.

In the nMOS transistor 122, the gate is connected to node N1 via the inverters 143 and 144, the source is connected to the output terminal OUT, and the drain is connected to the source of the voltage VUO. In the nMOS transistor 122, the gate width is 30 $\mu$m and the gate length is 1 $\mu$m.

The switching circuit 130 is a transfer gate for supplying the ground potential, meaning a low level potential, to the output terminal OUT. The switching circuit 130 comprises a pMOS transistor 131 and nMOS transistor 132. For the same reasons as in the case of the switching circuit 120, a transistor with a broad gate width and short gate length is used as the pMOS transistor 131. In addition, for the same reasons as in the case of the switching circuit 120, the voltage VUO is used as the control voltage of the transistors 131 and 132.

In the pMOS transistor 131, the gate is connected to node N2 via the inverter 145, the source is connected to the output terminal OUT, and the drain is connected to the ground line. In the pMOS transistor 131, the gate width is 50 $\mu$m and the gate length is 1 $\mu$m.

In the nMOS transistor 132, the gate is connected to node N2 via inverters 145 and 146, the source is connected to the ground line, and the drain is connected to the output terminal OUT. In the nMOS transistor 132, the gate width is 30 $\mu$m and the gate length is 1 $\mu$m.

The inverters 141–146 each comprise one pMOS transistor and one nMOS transistor. The internal constitution of the inverters 141–146 is the same as in known inverters and is therefore not shown in the drawings.

In the inverter 141, the gate width of the pMOS transistor is 10 $\mu$m and the gate length of the pMOS transistor is 1 $\mu$m; the gate width of the nMOS transistor is 10 $\mu$m and the gate length of the nMOS transistor is 1 $\mu$m.

In the inverter 142, the gate width of the pMOS transistor is 10 $\mu$m and the gate length of the pMOS transistor is 1 $\mu$m; the gate width of the nMOS transistor is 10 $\mu$m and the gate length of the nMOS transistor is 1 $\mu$m.

In the inverter 143, the gate width of the pMOS transistor is 3 $\mu$m and the gate length of the pMOS transistor is 1 $\mu$m; the gate width of the nMOS transistor is 3 $\mu$m and the gate length of the nMOS transistor is 1 $\mu$m.

In the inverter 144, the gate width of the pMOS transistor is 10 $\mu$m and the gate length of the pMOS transistor is 1 $\mu$m; the gate width of the nMOS transistor is 5 $\mu$m and the gate length of the nMOS transistor is 1 $\mu$m.

In the inverter 145, the gate width of the pMOS transistor is 3 $\mu$m and the gate length of the pMOS transistor is 1 $\mu$m; the gate width of the nMOS transistor is 3 $\mu$m and the gate length of the nMOS transistor is 1 $\mu$m.

In the inverter 146, the gate width of the pMOS transistor is 10 $\mu$m and the gate length of the pMOS transistor is 1 $\mu$m; the gate width of the nMOS transistor is 5 $\mu$m and the gate length of the nMOS transistor is 1 $\mu$m.

Figure 2:
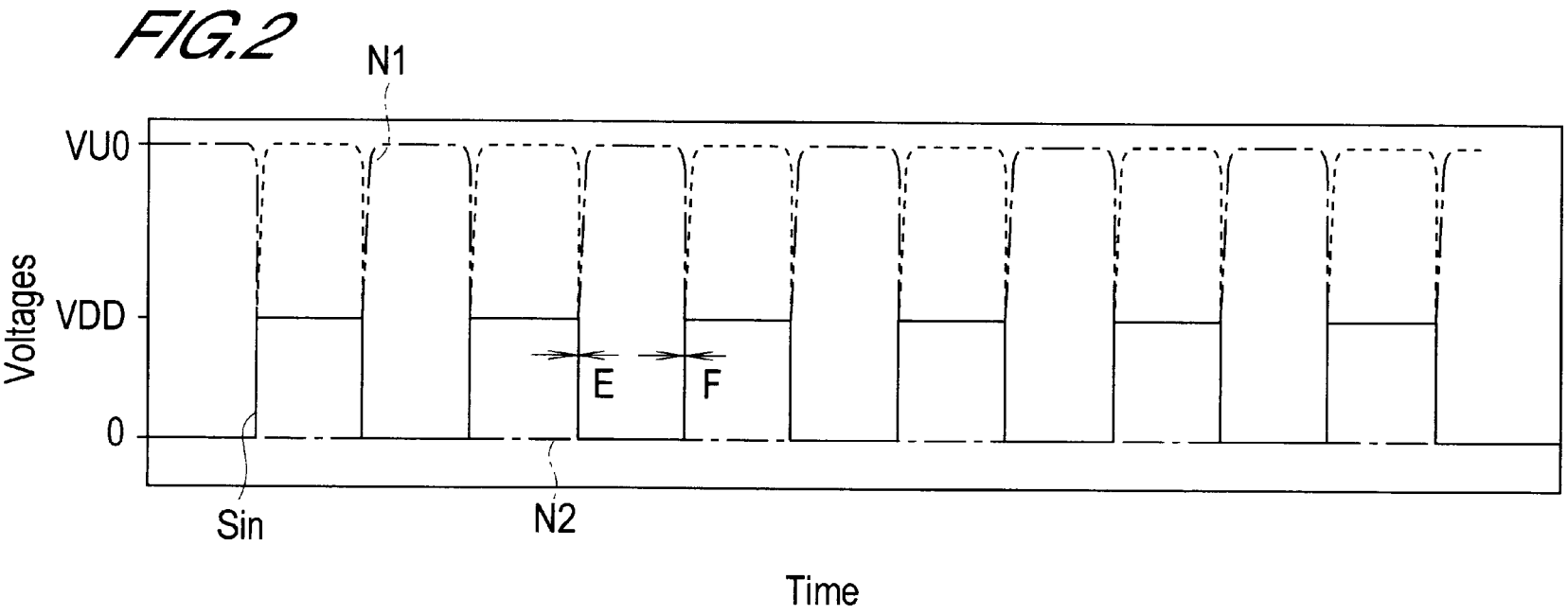
FIGS. 2, 3A, 3B, 4, 5A and 5B are waveform diagrams to explain the operation of the driver circuit shown in FIG. 1.
Figure 3A:
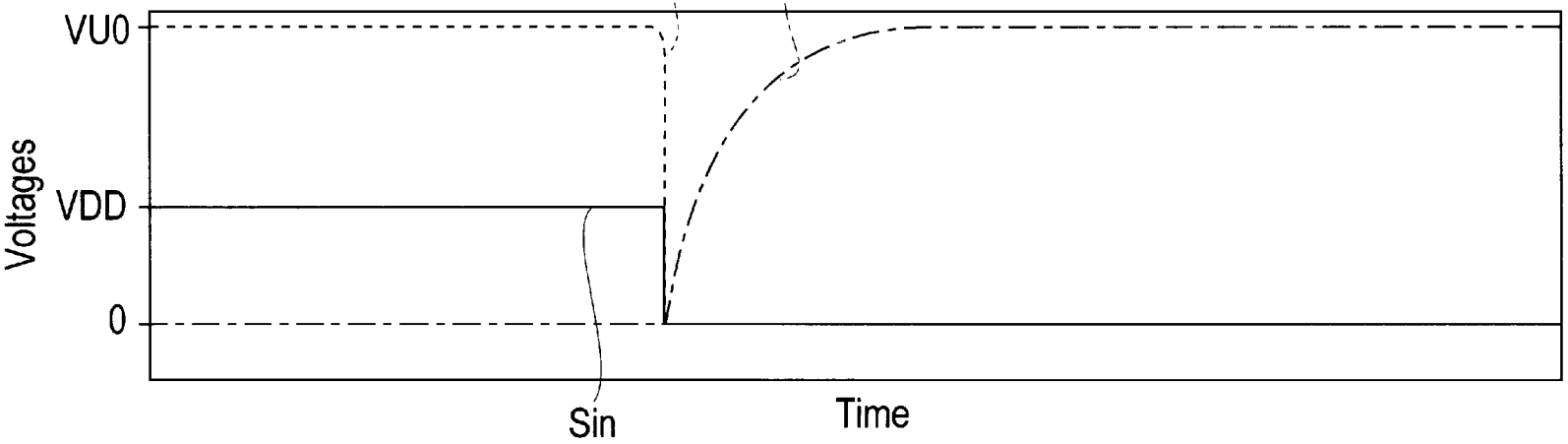
Figure 3B:
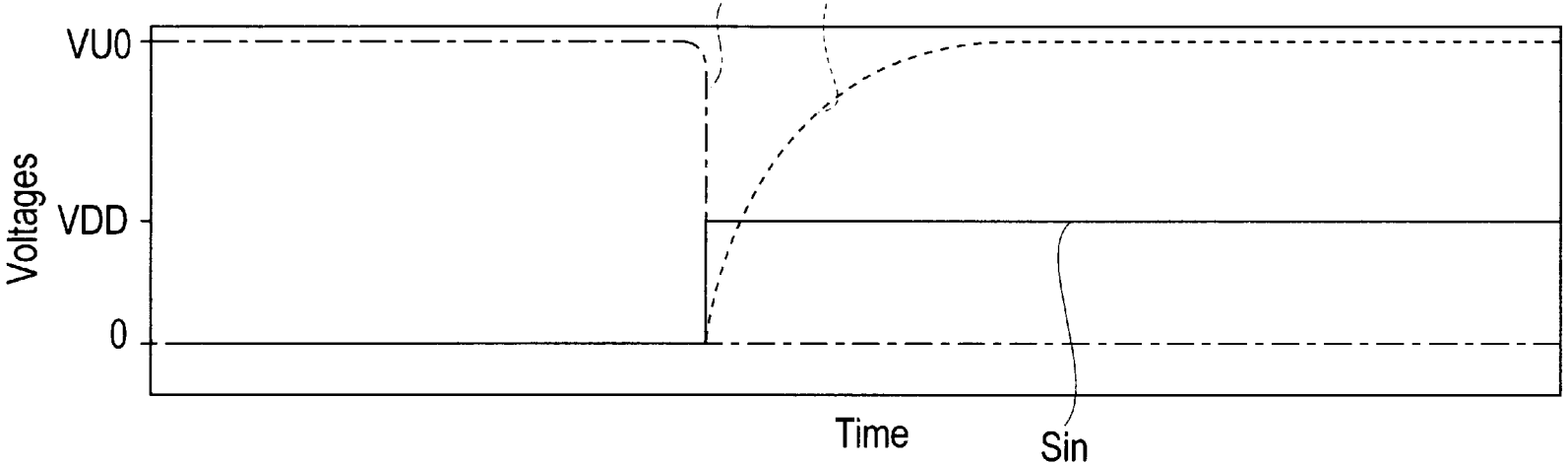
Figure 4:
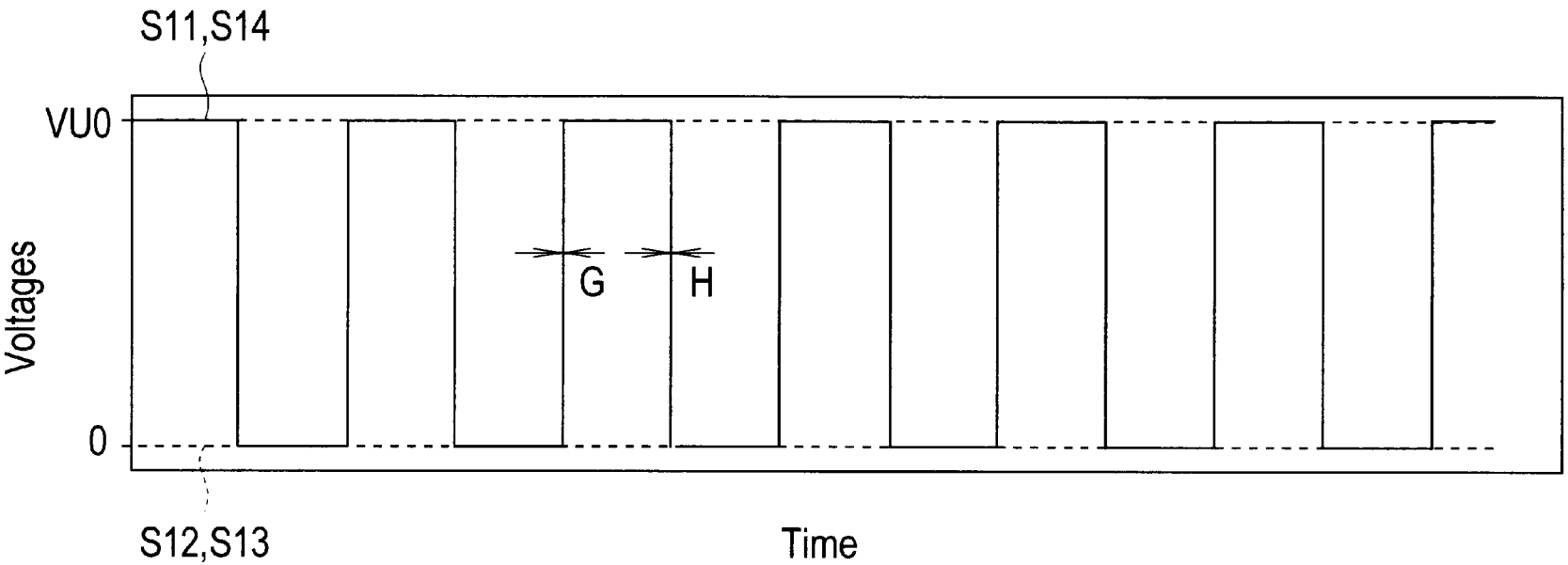
Figure 5A:
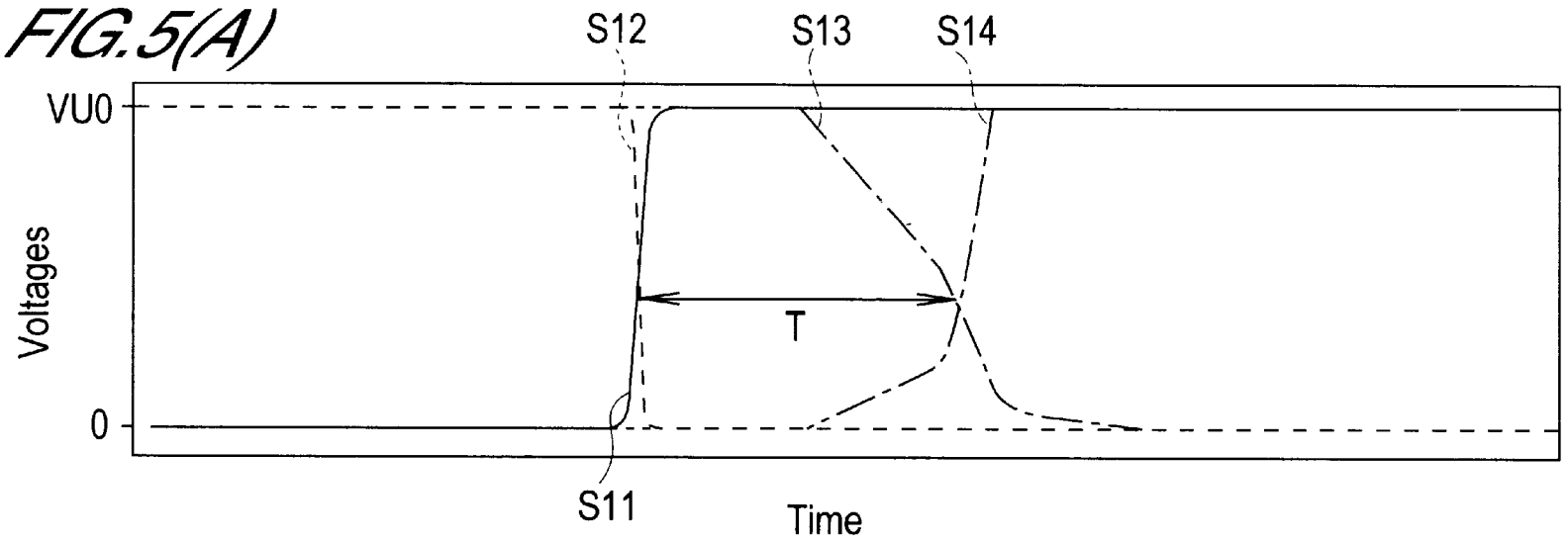
Figure 5B:
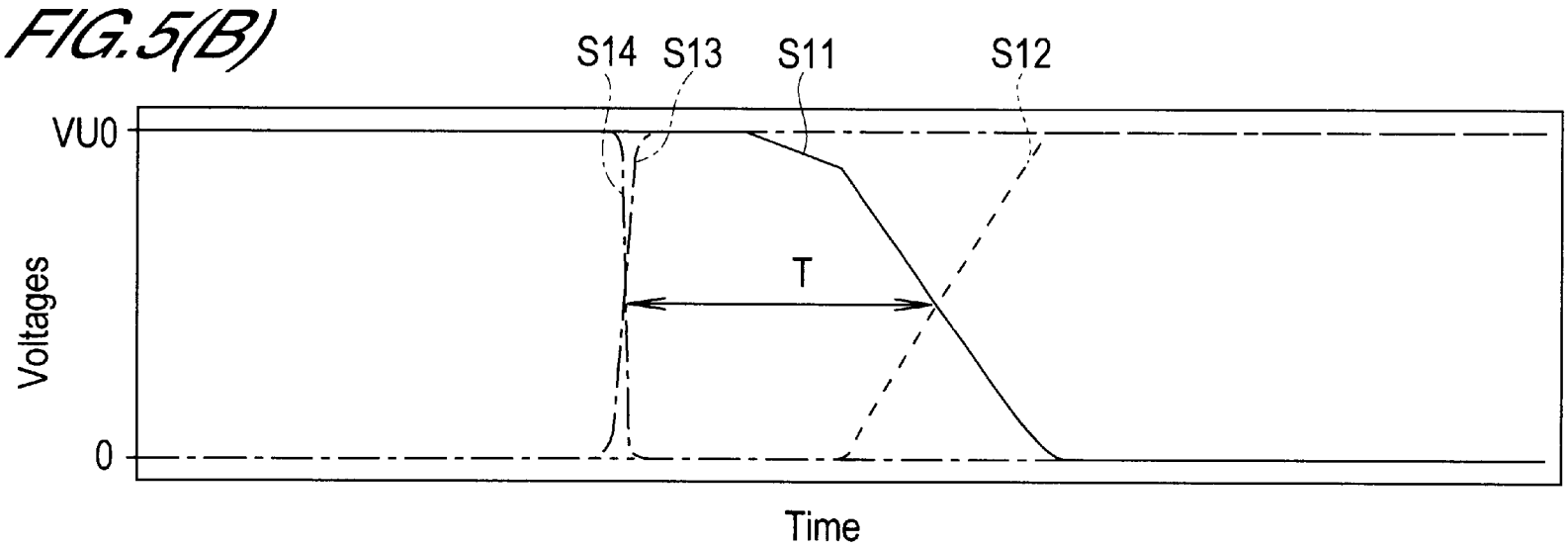

Next, the operation of the driver circuit 100 shown in FIG. 1 is explained using FIGS. 2–5B. FIG. 2 is a waveform diagram showing simulation results for the signal Sin and nodes N1 and N2. FIG. 3A is an enlarged detail of portion E in FIG. 2 and FIG. 3B is an enlarged detail of portion F in FIG. 2. FIG. 4 is a waveform diagram showing simulation results for signals S11–S14. FIG. 5A is an enlarged detail of portion G in FIG. 4, and FIG. 5B is an enlarged detail of portion H in FIG. 4.

As discussed above, the driver circuit 100 receives the signal Sin from the logic circuit in the preceding stage, not shown.

When the signal Sin is high level, a low level signal is input to the gate of the nMOS transistor 112 and a high level signal is input to the gate of the nMOS transistor 114. Consequently, the nMOS transistor 112 is in an OFF state and the nMOS transistor 114 is in an ON state. When the nMOS transistor 114 is in an ON state, the node N2 is connected to ground. Consequently, the potential of the node N2 is zero volts, meaning low level. In addition, when the node N2 is low level, the pMOS transistor 111 is in a ON state. Consequently, the voltage VUO is applied to the node N1. The potential of the node N1 is VUO, or high level, because the nMOS transistor 112 is in an OFF state as discussed above. When the potential of the node N1 is VUO, the pMOS transistor 113 is in an OFF state.

Because the node N1 is high level, the output signal S11 of the inverter 143 is low level and the output signal S12 of the inverter 144 is high level. Consequently, the gate potential of the pMOS transistor 121 is low level and the gate potential of the nMOS transistor 122 is high level. For this reason, the pMOS transistor 121 and nMOS transistor 122 are in an ON state. Meanwhile, because the node N2 is low level, the output signal S13 of the inverter 145 is high level and the output signal S14 of the inverter 146 is low level. Consequently, the gate potential of the pMOS transistor 131 is high level and the gate potential of the nMOS transistor 132 is low level. For this reason, the pMOS transistor 131 and nMOS transistor 132 are in an OFF state. As a result, the potential of the output terminal OUT is VUO, or high level.

When the signal Sin changes from high level to low level, the gate potential of the nMOS transistor 112 changes to high level and the gate potential of the nMOS transistor 114 changes to low level. Consequently, the nMOS transistor 12 changes to ON and the nMOS transistor 114 changes to OFF.

When the nMOS transistor 112 is ON, pass-through current flows in the transistors 111 and 112. Consequently, as shown in FIG. 3A, the potential of node N1 drops abruptly from high level to low level. Accordingly, as shown in FIG. 5A, the output signal S11 of the inverter 143 abruptly rises and the output signal S12 of the inverter 144 abruptly drops. Consequently, the switching circuit 120 abruptly opens.

When the potential of node N1 drops and becomes lower than the threshold voltage of the pMOS transistor 113, the pMOS transistor 113 becomes ON and as a result, the potential of the node N2 rises from low level to high level. When the potential of node N2 rises and becomes higher than the threshold voltage of the pMOS transistor 111, the pMOS transistor 111 becomes OFF. As shown in FIG. 3A, the potential of the node N2 gradually rises. Accordingly, as shown in FIG. 5A, the output signal S13 of the inverter 145 gradually drops and the output signal S14 of the inverter 146 gradually rises. Consequently, the switching circuit 130 slowly closes.

As discussed above, the switching circuit 120 opens abruptly and the switching circuit 130 closes slowly. For this reason, the time period T, wherein the switching circuits 120 and 130 are both open, occurs as shown in FIG. 5A.

Next, when the signal Sin changes from low level to high level, the gate potential of the nMOS transistor 112 changes to a low level and the gate potential of the nMOS transistor 114 changes to high level. Consequently, the nMOS transistor 112 becomes OFF and the nMOS transistor 114 becomes ON.

When the nMOS transistor 114 becomes ON, the potential of the node N2 drops abruptly from high level to low level as shown in FIG. 3B. Accordingly, as shown in FIG. 5B, the output signal S13 of the inverter 145 rises abruptly and the output signal S14 of the inverter 146 drops abruptly. Consequently, the switching circuit 130 opens abruptly.

When the potential of the node N2 drops and becomes less than the threshold voltage of the pMOS transistor 111, the pMOS transistor 111 becomes ON; as a result, the potential of the node N1 rises from low level to high level. When the potential of the node N1 rises and becomes higher than the threshold voltage of the pMOS transistor 113, the pMOS transistor 113 becomes OFF. The potential of the node N1 rises gradually as shown in FIG. 3B. Accordingly, as shown in FIG. 5B, the output signal S11 of the inverter 143 drops gradually and the output signal S12 of the inverter 144 rises gradually. Consequently, the switching circuit 120 closes gradually.

For this reason, the time period T, wherein both switching circuits 120 and 130 are both open, occurs as shown in FIG. 5B.

As discussed above, the driver circuit 100 relating to the present embodiment utilizes the fact that the potentials of the nodes N1 and N2 in the level shifter 110 change quickly when rising and slowly when falling, causing the time period T wherein both switching circuits 120 and 130 are open. In other words, a time when both the switching circuits 120 and 130 are closed does not occur in the driver circuit 100. Consequently, because there is no flow of pass-through current between switching circuits 120 and 130, there is no degradation of image quality for the display device. Pass-through current flows between transistors 111 and 112 and between transistors 113 and 114, but is not a factor in reduced image quality because this pass-through current does not influence the voltage level of the terminal OUT.

The driver circuit 100 can be constituted with few gates and consequently the layout design thereof is easy.

Second Embodiment

Figure 6:
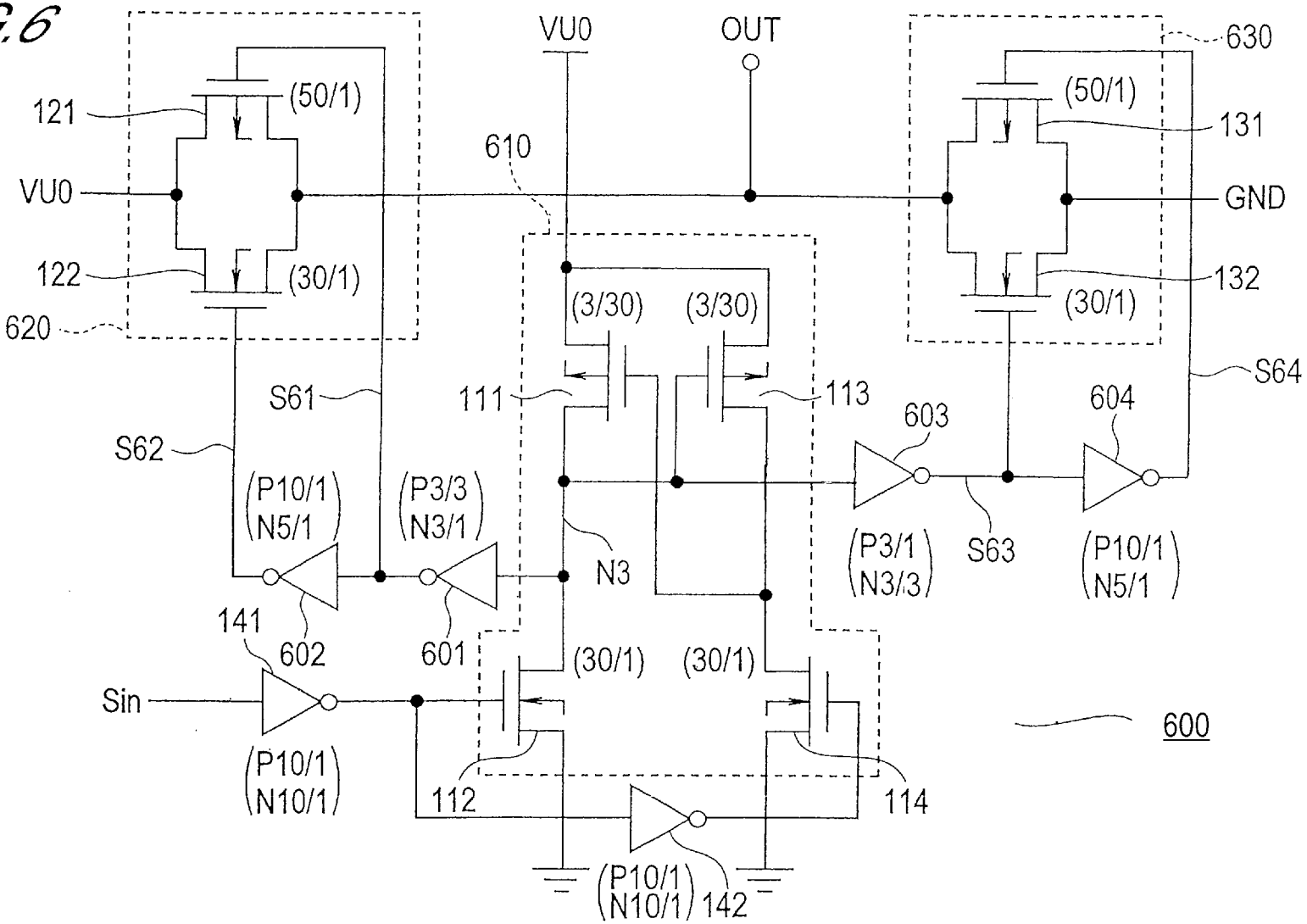
FIG. 6 is a circuit diagram showing the constitution of the display device driver circuit relating to the second embodiment.

FIG. 6 is a diagram of the constitution of the driver circuit relating to the second embodiment of the present invention.

As shown in FIG. 6, the driver circuit 600 relating to the present embodiment comprises a level shifter 610, switching circuits 620 and 630, and inverters 141, 142, and 601–604. The level shifter 610 and inverters 141, 142, and 601–604 constitute a selecting circuit for controlling the switching circuits 620 and 630.

In FIG. 6, the numbers in parentheses associated with the transistors show the gate width and gate length of each transistor. The numbers in parentheses associated with the inverters show the gate width and gate length of the pMOS transistors and nMOS transistors within the inverters.

The driver circuit 600 receives a signal Sin from the logic circuit in the previous stage, not shown, and converts the potential of this signal Sin from VDD to VUO. The converted signal is output from the output terminal OUT.

The level shifter 610 converts the high level potential of the signal Sin from VDD to VUO. The converted potential is supplied to the switching circuits 620 and 630. The level shifter 610 comprises pMOS transistors 111 and 113, and nMOS transistors 112 and 114. The sizes and connective relationships of the transistors 111–114 are the same as in the level shifter 110 in FIG. 1.

The switching circuit 620 is a transfer gate for supplying the voltage VUO, meaning a high level potential, to the output terminal OUT. The switching circuit 620 comprises pMOS transistor 121 and nMOS transistor 122. The sizes and connective relationships of the transistors 121 and 122 are the same as in the switching circuit 120 in FIG. 1.

The switching circuit 630 is a transfer gate for supplying the ground potential, meaning a low level potential, to the output terminal OUT. The switching circuit 630 comprises a pMOS transistor 131 and nMOS transistor 132. The sizes and connective relationships of the transistors 131 and 132 are the same as in the switching circuit 130 in FIG. 1.

The inverters 141, 142, and 601~604 each comprise one pMOS transistor and one nMOS transistor, not shown.

The sizes and connective relationships of the inverters 141 and 142 are the same as in the driver circuit in FIG. 1.

The input terminal of the inverter 601 is connected to the node N3; the output terminal of the inverter 601 is connected to the gate of the pMOS transistor 121. In the inverter 601, the gate width of the pMOS transistor is 3 $\mu$m and the gate length of the pMOS transistor is 3 $\mu$m; the gate width of the nMOS transistor is 3 $\mu$m and the gate length of the nMOS transistor is 1 $\mu$m. That is, the gate length of the pMOS transistor in the inverter 601 is different from the inverter 143 in FIG. 1.

In the inverter 602, the input terminal is connected to the output terminal of the inverter 601 and the output terminal is connected to the gate of the nMOS transistor 122. The sizes of the transistors comprising the inverter 602 are the same as in the inverter 144 in FIG. 1.

The input terminal of the inverter 603 is connected to node N3 and the output terminal of the inverter 603 is connected to the gate of the nMos transistor 132. In the inverter 603, the gate width of the pMOS transistor is 3 $\mu$m and the gate length of the pMOS transistor is 1 $\mu$m; the gate width of the nMOS transistor is 3 $\mu$m and the gate length of the nMOS transistor is 3 $\mu$m. That is, the connective relationships and gate length of the nMOS transistor in the inverter 603 are different from those of the inverter 145 in FIG. 1.

The input terminal of the inverter 604 is connected to the output terminal of the inverter 603; the output terminal of the inverter 604 is connected to the gate of the pMOS transistor 131. The sizes of the transistors comprising the inverter 604 are the same as those in the inverter 146 in FIG. 1. Specifically, the inverter 604 differs from the inverter 146 in FIG. 1 in that the output terminal is connected to the pMOS transistor 131.

As discussed above, the inverter 601 and inverter 603 have different sized transistors. Because of this difference, the inverter 601 operates more quickly than the inverter 603 when the node N3 changes from high level to low level, and the inverter 603 operates more quickly than the inverter 601 when the node N3 changes from low level to high level.

Figure 7:
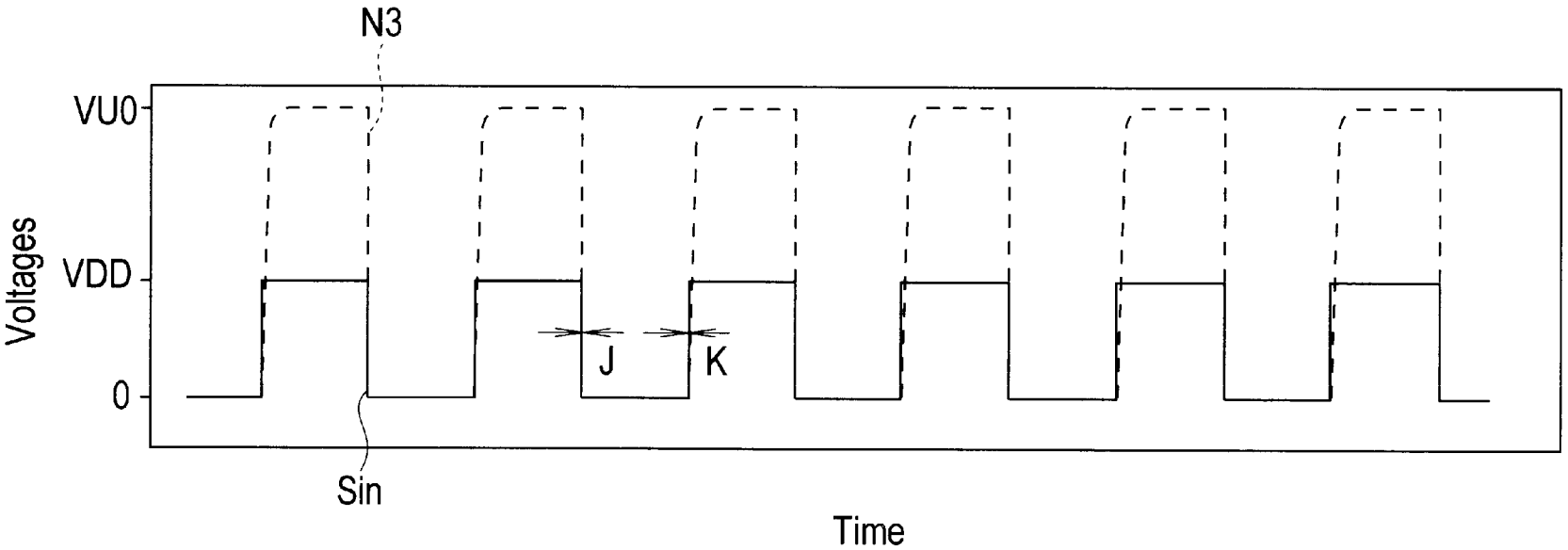
FIGS. 7, 8A, 8B, 9, 10A and 10B are waveform diagrams to explain the operation of the driver circuit shown in FIG. 6.
Figure 8A:
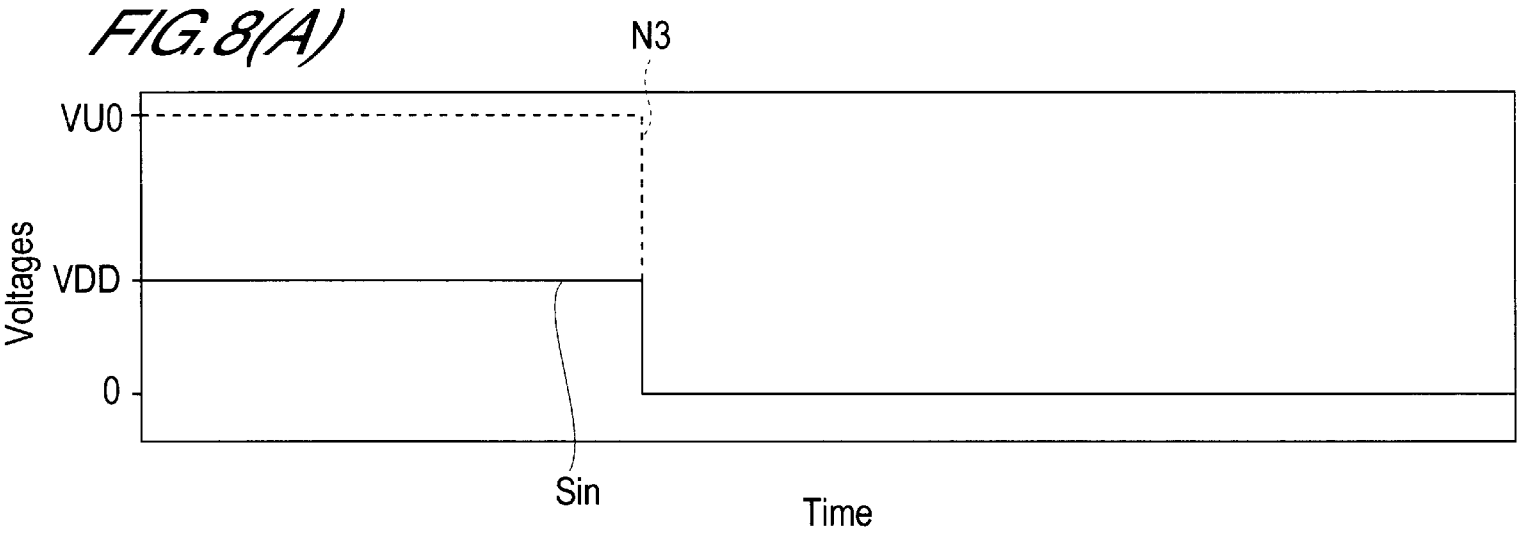
Figure 8B:
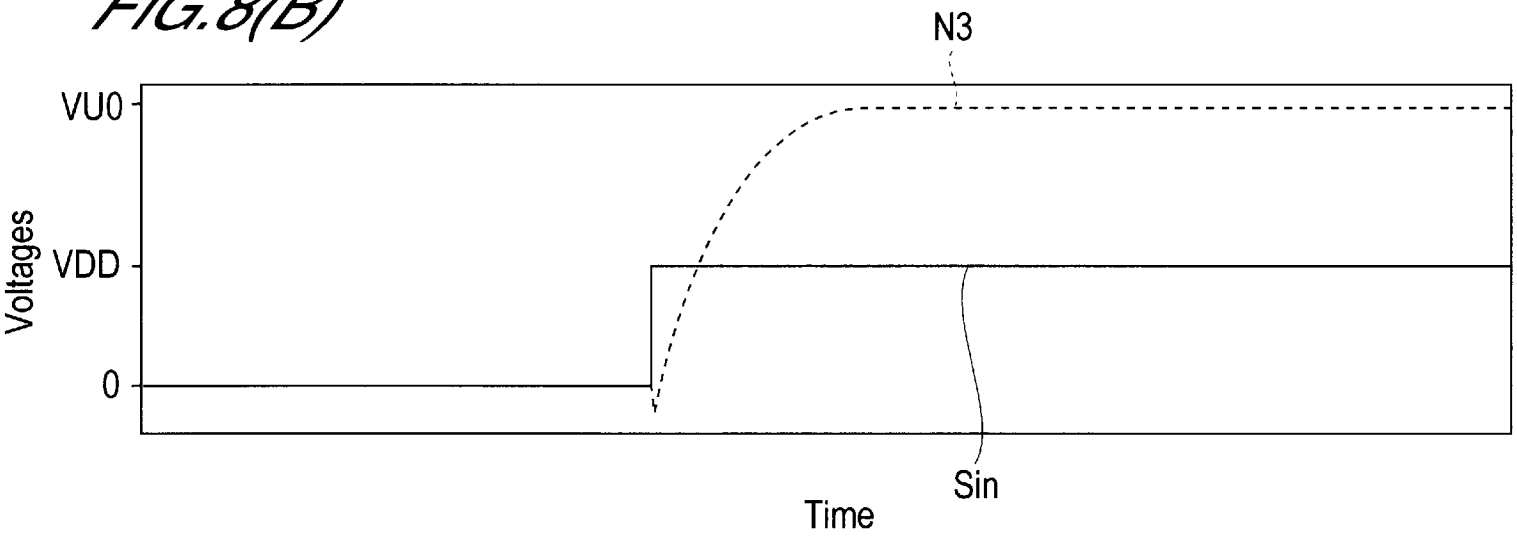
Figure 9:
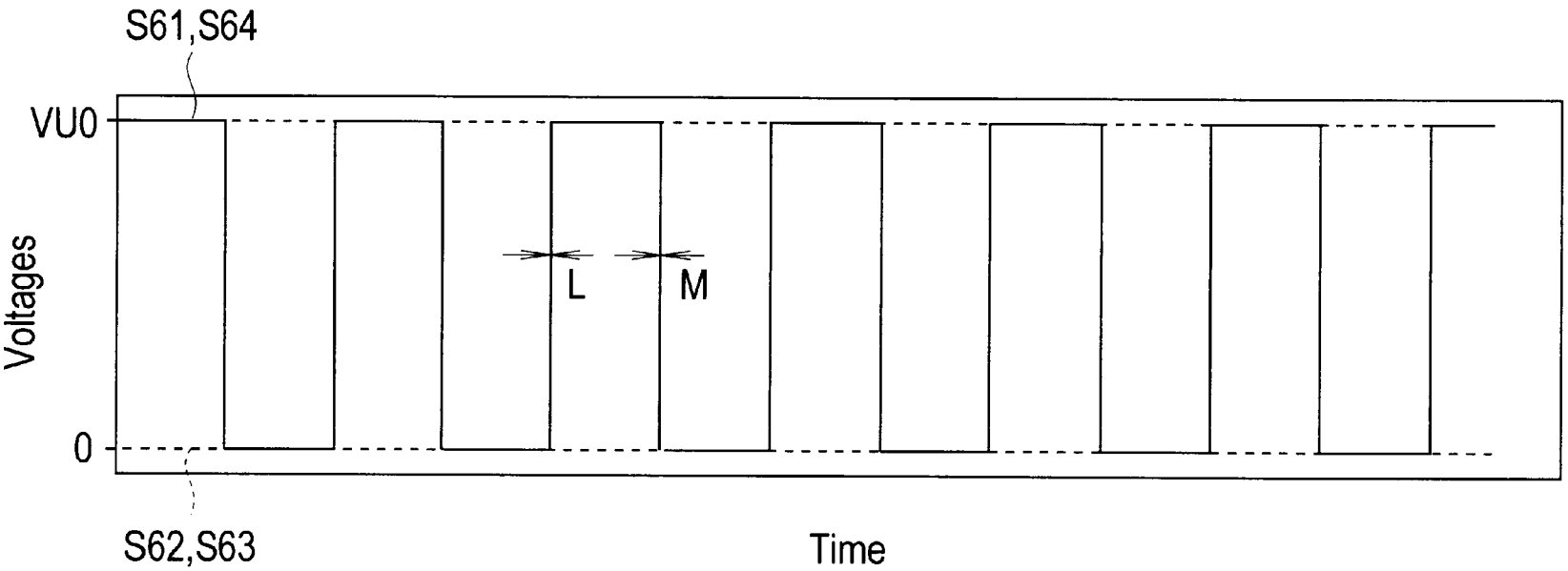
Figures 10A, 10B:
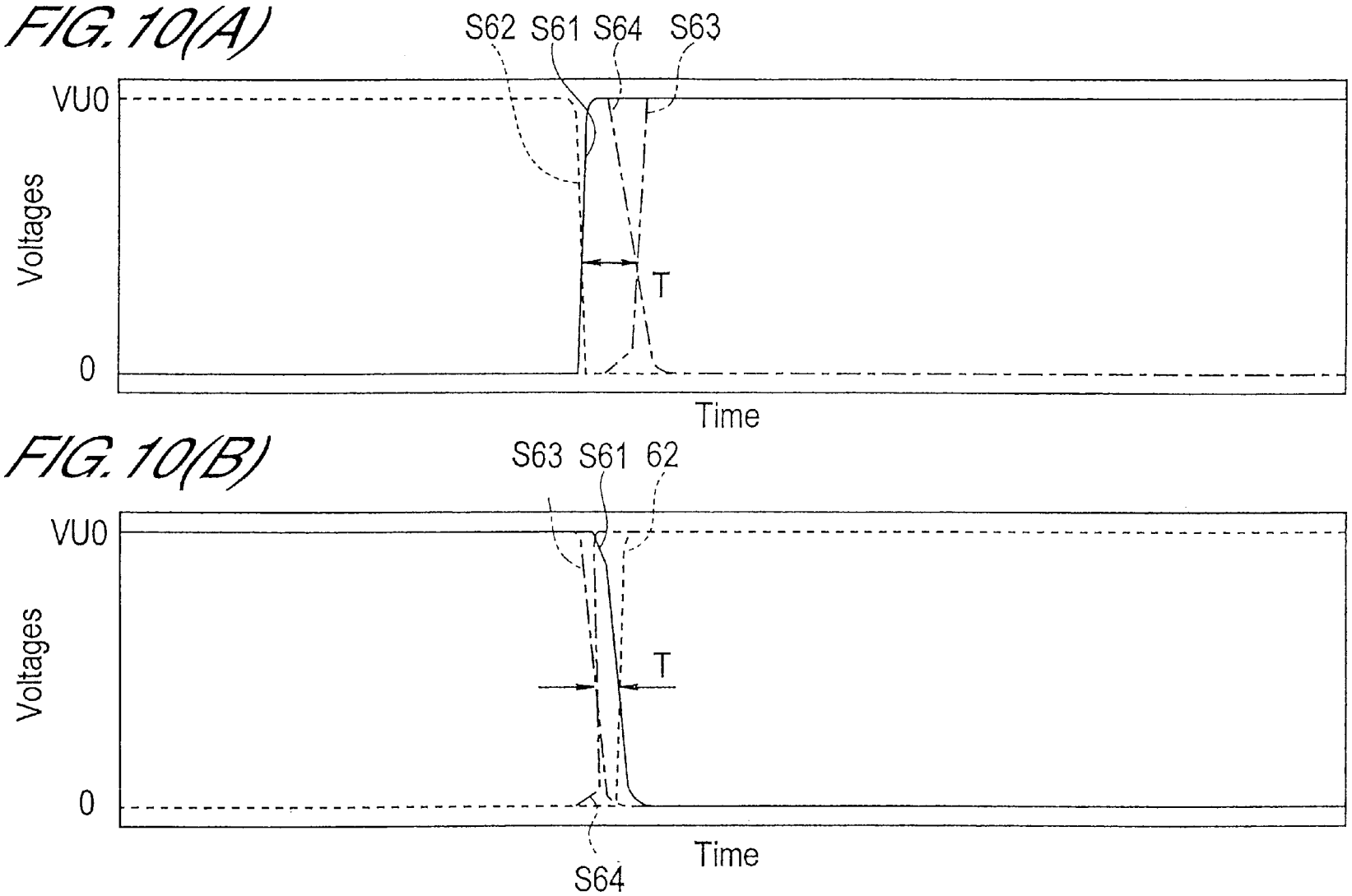

Next, the operation of the driver circuit 600 shown in FIG. 6 is explained using FIGS. 7–10B. FIG. 7 is a waveform diagram showing simulation results of the signal Sin and node N3. FIG. 8A is an enlarged detail of section J in FIG. 7; FIG. 8B is an enlarged detail of section K in FIG. 7. FIG. 9 is a waveform diagram showing simulation results for signals S61–S64. FIG. 10A is an enlarged detail of section L in FIG. 9; FIG. 10B is an enlarged detail of section M in FIG. 9.

As discussed above, the driver circuit 600 receives the signal Sin from the logic circuit in the preceding stage, not shown.

When the signal Sin is high level, a low level signal is input to the gate of the nMOS transistor 112 and a high level signal is input to the gate of the nMOS transistor 114. Consequently, the nMOS transistor 112 is OFF and the nMOS transistor 114 is ON. When the nMOS transistor 114 is ON, the pMOS transistor 111 is ON because the gate is low level. Consequently, the voltage VUO is applied to the node N3. As discussed above, the nMOS transistor 112 is OFF, so the potential of the node N3 is VUO, meaning high level. When the potential of the node N3 is VUO, the nMOS transistor 113 is OFF.

When the node N3 is high level, the output signal S61 of the inverter 601 is low level and the output signal S62 of the inverter 602 is high level. Consequently, the gate potential of the pMOS transistor 121 is low level and the gate potential of the nMOS transistor 122 is high level. For this reason, the pMOS transistor 121 and nMOS transistor 122 are ON. Meanwhile, when the node N3 is high level, the output signal S63 of the inverter 603 is low level and the output signal S64 of the inverter 604 is high level. Consequently, the gate potential of the pMOS transistor 131 is high level and the gate potential of the nMOS transistor 132 is low level. The pMOS transistor 131 and nMOS transistor 132 are therefore OFF. As a result, the potential of the output terminal OUT is VUO, meaning high level.

When the signal Sin changes from high level to low level, the gate potential of the nMOS transistor 112 changes to a high level and the gate potential of the nMOS transistor 114 changes to low level. Consequently, the nMOS transistor 112 changes to ON and the nMOS transistor 114 changes to OFF.

When the nMOS transistor 112 is made ON, the potential of the node N3 changes from high level to low level. As discussed above, the inverter 601 operates faster than the inverter 603 when the node N3 changes from high level to low level. Consequently, the output signal S61 of the inverter 601 rises abruptly and the output signal S62 of the inverter 602 drops abruptly as shown in FIG. 10A. Meanwhile, the output signal S63 of the inverter 603 rises gradually and the output signal S64 of the inverter 604 drops gradually. Accordingly, the switching circuit 620 opens abruptly and the switching circuit 630 closes gradually.

For this reason, the time period T, wherein both switching circuits 620 and 630 are open, occurs as shown in FIG. 10A.

Next, when the signal Sin changes from low level to high level, the potential of the nMOS transistor 112 changes to a low level signal and the gate potential of the nMOS transistor 114 changes to high level. Consequently, the nMOS transistor 112 becomes OFF and the nMOS transistor 114 becomes ON.

When the nMOS transistor 114 goes ON, the potential of the node N3 changes from low level to high level as shown in FIG. 8B. As discussed above, when the node N3 changes from low level to high level, the inverter 603 operates more quickly than the inverter 601. Consequently, the output signal S63 of the inverter 603 falls abruptly and the output signal S64 of the inverter 604 rises abruptly as shown in FIG. 10B. Meanwhile, the output signal S61 of the inverter 601 falls gradually and the output signal S62 of the inverter 602 rises gradually. Accordingly, the switching circuit 630 opens abruptly and the switching circuit 620 closes gradually.

For this reason, the time period T, wherein both switching circuits 620 and 630 are open, occurs as shown in FIG. 10B.

As discussed above, the driver circuit 600 relating to the present embodiment utilizes the difference in operating speeds of the inverters 601 and 603, causing the time period T wherein both switching circuits 620 and 630 are open. In other words, a time when both the switching circuits 620 and 630 are closed does not occur in the driver circuit 600. Consequently, because there is no flow of pass-through current between switching circuits 620 and 630, there is no degradation of image quality for the display device. Pass-through current flows between transistors 111 and 112 and between transistors 113 and 114, but is not a factor in reduced image quality because this pass-through current does not influence the voltage level of the terminal OUT.

The driver circuit 600 can be constituted with few gates and consequently the layout design thereof is easy.

In the driver circuits 100 and 600 discussed above, the switching circuits 120, 130, 620, and 630 are each constituted of two switch elements. However, these switching circuits may also each be constituted of one switching element. When the switching circuits are constituted with one switching element, some of the inverters become unnecessary.

In the driver circuit 600 discussed above, only one node is used; as a result, a more simple circuit can be used instead of the level shifter 610. For example, a circuit for waveform re-shaping the logic signal Sin using the source voltage VUO can be used instead of the level shifter 610.

What is claimed is:

1. A display device driver circuit for a liquid crystal element, comprising:

a first source line that supplies a driving voltage for the liquid crystal element;

a second source line that supplies a ground voltage;

a first switch that switchably connects and disconnects an output terminal and said first source line;

a second switch that switchably connects and disconnects the output terminal and said second source line; and a selector that sets a voltage level of the output terminal by opening one of said first and second switches while closing an other of said first and second switches, said selector controlling said first and second switches so that one of said first and second switches does not close before the other of said first and second switches opens completely.

2. The display device driver circuit, according to claim 1, wherein said selector comprises:

a first node having a voltage level that changes abruptly from a first level to a second level when a logic value of an input signal changes from said first level to said second level, and that changes gradually from said second level to said first level when said logic value of said input signal changes from said second level to said first level; and a second node having a voltage level that changes gradually from said second level to said first level when said logic value of said input signal changes from said first level to said second level, and that changes abruptly from said first level to said second level when said logic value of said input signal changes from said second level to said first level.

3. The display device driver circuit, according to claim 2, wherein said selector comprises:

a first transistor of first conductive type, having a first terminal connected to a third source line, a second terminal connected to said first node, and a control terminal connected to said second node;

a second transistor of second conductive type, having a first terminal connected to a fourth source line, a second terminal connected to said first node, and a control terminal that receives an inverted logic value that is opposite said logic value of said input signal;

a third transistor of said first conductive type, having a first terminal connected to said third source line, a second terminal connected to said second node, and a control terminal connected to said first node; and a fourth transistor of said second conductive type, having a first terminal connected to said fourth source line, a second terminal connected to said second node, and a control terminal connected to the logic value of said input signal.

4. The display device driver circuit, according to claim 3, wherein said selector comprises:

a first inverter having an input terminal connected to said input signal and an output terminal connected to said control terminal of said second transistor; and a second inverter having an input terminal connected to said output terminal of said first inverter and an output terminal connected to said control terminal of said fourth transistor.

5. The display device driver circuit, according to claim 3, wherein said third source line is said first source line and said fourth source line is said second source line.

6. The display device driver circuit, according to claim 2, wherein said first switch is closed when a potential of said first node is said first level and is open when the potential of said first node is said second level.

7. The display device driver circuit, according to claim 6, wherein said first switch comprises:

a first transistor of first conductive type, having a first terminal connected to said first source line, a second terminal connected to said output terminal, and a control terminal connected to a potential opposite the voltage level of said first node; and a second transistor of second conductive type, having a first terminal connected to said output terminal, a second terminal connected to said first source line, and a control terminal connected to a potential that is the same as the voltage level of said first node.

8. The display device driver circuit, according to claim 7, wherein said selector comprises:

a first inverter having an input terminal connected to said first node and an output terminal connected to said control terminal of said first transistor; and a second inverter having an input terminal connected to said output terminal of said first inverter and an output terminal connected to said control terminal of said second transistor.

9. The display device driver circuit, according to claim 2, wherein said second switch is closed when a potential of said second node is said first level and is open when the potential of said second node is said second level.

10. The display device driver circuit, according to claim 9, wherein said second switch comprises:

a first transistor of first conductive type, having a first terminal connected to said output terminal, a second terminal connected to said second source line, and a control terminal connected to a potential opposite the voltage level of said second node; and a second transistor of second conductive type, having a first terminal connected to said second source line, a second terminal connected to said output terminal, and a control terminal connected to a potential that is the same as the voltage level of said second node.

11. The display device driver circuit, according to claim 10, wherein said selector comprises:

a first inverter having an input terminal connected to said second node and an output terminal connected to said control terminal of said first transistor; and a second inverter having an input terminal connected to said output terminal of said fifth inverter and an output terminal connected to said control terminal of said second transistor.

12. The display device driver circuit, according to claim 1, wherein said selector comprises:

a first node having a voltage level that changes from a first level to a second level when a logic value of the input signal changes from said first level to said second level, and that changes from said second level to said first level when said logic value of said input signal changes from said second level to said first level;

a first inverter having an output voltage level that changes abruptly from the second level to the first level when said first node changes from said first level to said second level, and that changes gradually from said first level to said second level when said first node changes from said second level to said first level; and a second inverter having an output voltage level that changes gradually from the second level to the first level when said first node changes from said first level to said second level, and that changes abruptly from said first level to said second level when said first node changes from said second level to said first level.

13. The display device driver circuit, according to claim 12, wherein said selector comprises:

a first transistor of first conductive type, having a first terminal connected to a third source line and a second terminal connected to said first node;

a second transistor of second conductive type, having a first terminal connected to a fourth source line, a second terminal connected to said first node, and a control terminal connected to a logic value that is opposite said logic value of said input signal;

a third transistor of said first conductive type, having a first terminal connected to said third source line and a control terminal connected to said first node; and a fourth transistor of said second conductive type, having a first terminal connected to said fourth source line, a second terminal connected to a control terminal of said first transistor and a second terminal of said third transistor, and a control terminal connected to the logic value of said input signal.

14. The display device driver circuit, according to claim 13, comprising:

a third inverter having an input terminal connected to said input signal and an output terminal connected to said control terminal of said second transistor; and a fourth inverter having an input terminal connected to said output terminal of said third inverter and an output terminal connected to said control terminal of said fourth transistor.

15. The display device driver circuit, according to claim 13, wherein said third source line is said first source line and said fourth source line is said second source line.

16. The display device driver circuit, according to claim 12, wherein said first switch is closed when the output voltage level of said first inverter is at said second level and open when the output voltage level of said first inverter is at said first level.

17. The display device driver circuit, according to claim 16, wherein said first switch comprises:

a first transistor of first conductive type, having a first terminal connected to said first source line, a second terminal connected to said output terminal, and a control terminal connected to the output voltage level of said first inverter; and a second transistor of second conductive type, having a first terminal connected to said output terminal, a second terminal connected to said first source line, and a control terminal connected to a potential that is opposite the output voltage level of said first inverter.

18. The display device driver circuit, according to claim 17, comprising a third inverter having an input terminal connected to an output terminal of said first inverter and an output terminal connected to said control terminal of said first transistor.

19. The display device driver circuit, according to claim 12, wherein said second switch is closed when the output voltage level of said second inverter is at said first level and open when the output voltage level of said second inverter is at said second level.

20. The display device driver circuit, according to claim 19, wherein said second switch comprises:

a first transistor of first conductive type, having a first terminal connected to said output terminal, a second terminal connected to said second source line, and a control terminal connected to a potential opposite the output voltage level of said second inverter; and a second transistor of second conductive type, having a first terminal connected to said second source line, a second terminal connected to said output terminal, and a control terminal connected to the output voltage level of said second inverter.

21. The display device driver circuit, according to claim 20, comprising a third inverter having an input terminal connected to an output terminal of said second inverter and an output terminal connected to said control terminal of said second transistor.

22. A display device driver circuit comprising:

a first source line that supplies a first potential;

a second source line that supplies a second potential which is lower than the first potential;

an output terminal which outputs an output signal having either of the first and second potentials;

a first switching circuit provided between said first source line and said output terminal;

a second switching circuit provided between said second source line and said output terminal; and a selecting circuit which controls opening and closing of said first and second switching circuits so that when the output signal of said output terminal is switched between the first and second potentials, one of said first and second switching circuits is opened before another of said first and second switching circuits is closed.

23. The display device driver circuit of claim 22, wherein said first switching circuit is switched based on a voltage level of a first node in said selecting circuit and said second switching circuit is switched based on a voltage level of a second node in said selecting circuit, the voltage levels of the first and second nodes change abruptly when and rising gradually when falling.

24. The display device driver circuit of claim 23, wherein said selecting circuit comprises:

a first transistor of a first conductive type having a first terminal connected to the second potential, a second terminal connected to the first node and a control terminal connected to an input signal;

a second transistor of a second conductive type having a first terminal connected to the first potential, a second terminal connected to the first node, and a control terminal connected to the second node;

a third transistor of the first conductive type having a first terminal connected to the second potential, a second terminal connected to the second node, and a control terminal coupled to an inverted value of the input signal; and a fourth transistor of a second conductive type having a first terminal connected to the first potential, a second terminal connected to the second node and a control terminal connected to the first node.

25. The display device driver circuit of claim 24, wherein gate width and gate length of said first through fourth transistors are provided so that voltage levels of the first and second nodes change abruptly when rising and gradually when falling, responsive to a change in a voltage level of the input signal.

26. The display device driver circuit of claim 22, wherein said selecting circuit controls said first and second switching circuits so that a time does not occur when both said first and second switches are closed.

27. The display device driver circuit of claim 22, wherein said selecting circuit comprises:

a first transistor of a first conductive type having a first terminal connected to the second potential, a second terminal connected to a first node and a control terminal connected to an input signal;

a second transistor of a second conductive type having a first terminal connected to the first potential, a second terminal connected to the first node, and a control terminal connected to a second node;

a third transistor of the first conductive type having a first terminal connected to the second potential, a second terminal connected to the second node and a control terminal connected to an inverted value of the input signal; and a fourth transistor of the second conductive type having a first terminal connected to the first potential, a second terminal connected to the second node and a control terminal connected to the first node.

28. The display device driver circuit of claim 27, wherein said selecting circuit further comprises:

a first inverter having an input terminal connected to the first node, that provides a first control signal that controls opening and closing of said first switching circuit; and a second inverter having an input terminal connected to the first node, that provides a second control signal that controls opening and closing of said second switching circuit.

29. The display device driver circuit of claim 28, wherein transistors of said first and second inverters have gate widths and gate lengths whereby the first and second control signals are provided so that said first and second switching circuits open abruptly and close gradually responsive to a voltage level of the first node.

30. A display device driver circuit comprising:

a first switch that switchably connects and disconnects an output terminal and a first source line;

a second switch that switchably connects and disconnects the output terminal and a second source line; and a selector that respectively outputs first and second control signals to said first and second switches, to open one of said first and second switches while closing an other of said first and second switches, so that one of said first and second switches does not close before the other of said first and second switches opens completely.

31. The display device driver circuit of claim 30, wherein the first source line provides a driving voltage and the second source line provides a ground voltage.

* * * * *